US008678541B2

(12) United States Patent
Uchiyama

(10) Patent No.: US 8,678,541 B2
(45) Date of Patent: Mar. 25, 2014

(54) PRINTING DEVICE

(75) Inventor: Masanobu Uchiyama, Shimosuwa-machi (JP)

(73) Assignee: Seiko Epson Corporation, Tokyo (JP)

( * ) Notice: Subject to any disclaimer, the term of this patent is extended or adjusted under 35 U.S.C. 154(b) by 77 days.

(21) Appl. No.: 13/529,888

(22) Filed: Jun. 21, 2012

(65) Prior Publication Data

US 2012/0327155 A1 Dec. 27, 2012

(30) Foreign Application Priority Data

Jun. 23, 2011 (JP) ..... 2011-139525

(51) Int. Cl.
*B41J 29/393* (2006.01)

(52) U.S. Cl.
USPC ..... 347/19

(58) Field of Classification Search
USPC ..... 347/19
See application file for complete search history.

(56) References Cited

U.S. PATENT DOCUMENTS

| | | | | |
|---|---|---|---|---|
| 6,631,970 | B2 * | 10/2003 | Sato et al. | 347/19 |
| 6,749,281 | B2 * | 6/2004 | Asauchi | 347/19 |
| 7,607,758 | B2 * | 10/2009 | Hatasa et al. | 347/50 |
| 2007/0126770 | A1 | 6/2007 | Asauchi | |

FOREIGN PATENT DOCUMENTS

| | | | |
|---|---|---|---|
| JP | 05-299123 | A | 11/1993 |
| JP | 4539654 | B2 | 7/2010 |

* cited by examiner

*Primary Examiner* — Lamson Nguyen
(74) *Attorney, Agent, or Firm* — Kilpatrick Townsend & Stockton LLP

(57) ABSTRACT

A printing device, to which a printing material container having an electric device connected two first terminals and a wiring connecting two second terminals can be attached, includes: first and second detection terminals that contact the two first terminals; third and fourth detection terminals that contact the two second terminals; a first detection signal generator that outputs a first detection signal to the first detection terminal; a first detector that is connected to the second detection terminal; a second detection signal generator that outputs a second detection signal to the third detection terminal; a second detector that is connected to the fourth detection terminal; a high voltage generator that outputs high voltage to the first or the second detection terminal; an overvoltage detector; and a voltage drop element arranged between the overvoltage detector and the third or fourth detection terminal.

8 Claims, 12 Drawing Sheets

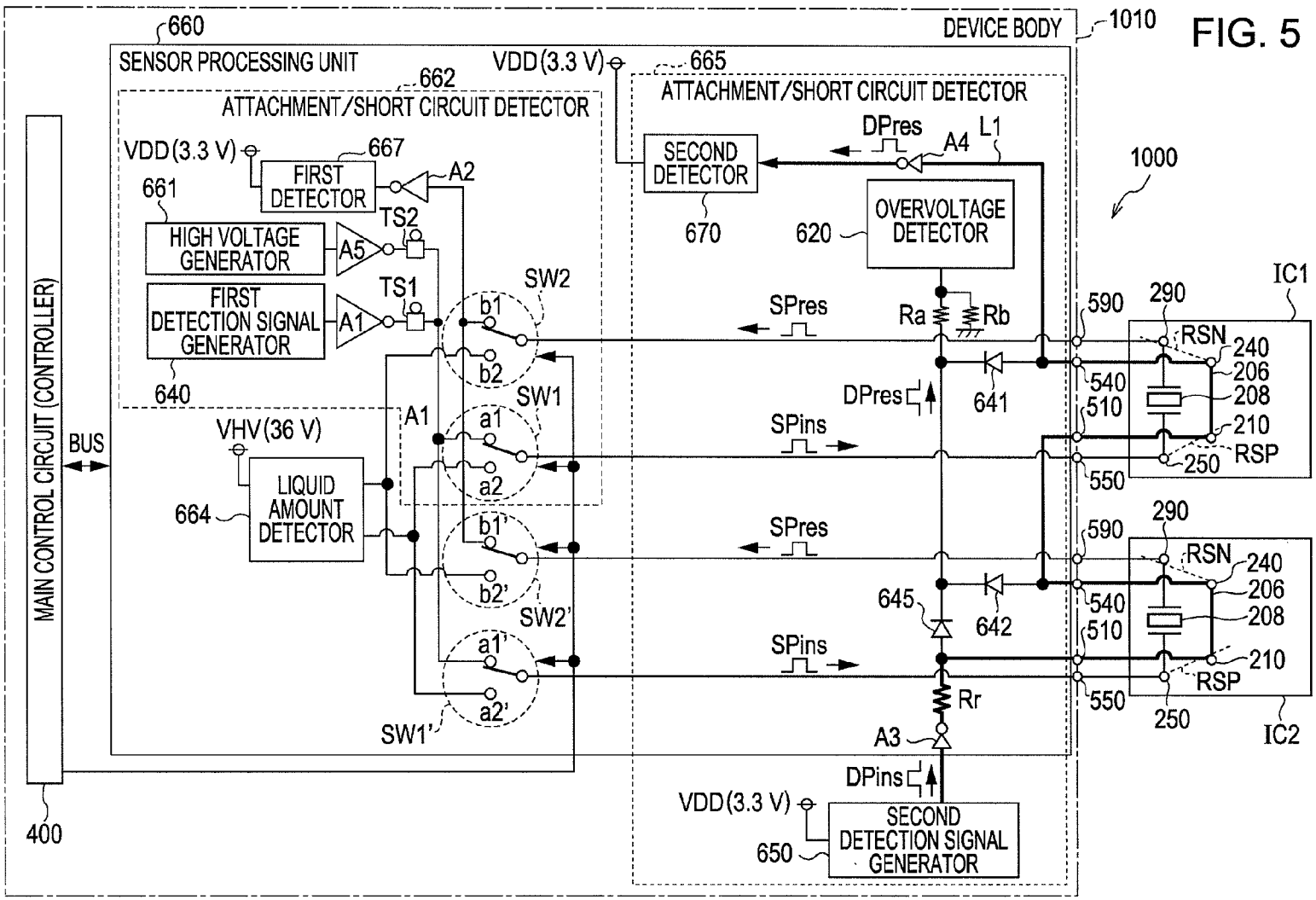
FIG. 5
1000
1010
DEVICE BODY
IC1
IC2
RSN
RSP
240
206
208
210
250
290
590
540
510
550
ATTACHMENT/SHORT CIRCUIT DETECTOR
665
OVERVOLTAGE DETECTOR
620
SECOND DETECTOR
670
SECOND DETECTION SIGNAL GENERATOR
650
DPres
DPins
SPres
SPins
L1
A4
A3
Ra
Rb
Rr
641
642
645
VDD(3.3 V)
SW1
SW2
SW1'
SW2'
a1
a2
b1
b2
a1'
a2'
b1'
b2'
A1
A2
A5
TS1
TS2
662
ATTACHMENT/SHORT CIRCUIT DETECTOR
660
SENSOR PROCESSING UNIT
667
FIRST DETECTOR
661
HIGH VOLTAGE GENERATOR
640
FIRST DETECTION SIGNAL GENERATOR
VHV(36 V)
664
LIQUID AMOUNT DETECTOR
BUS
MAIN CONTROL CIRCUIT (CONTROLLER)
400

DURING NORMAL STATE

CONTACT FAILURE OF TERMINAL 250 OR 290

CONTACT FAILURE OF TERMINAL 210 OR 240

LEAKAGE BETWEEN TERMINALS 240 AND 290

LEAKAGE BETWEEN TERMINALS 210 AND 250

PRINTING DEVICE

BACKGROUND

1. Technical Field

The present invention relates to a printing device or the like, which is capable of having a printing material container.

2. Related Art

For a printing device that has a detecting circuit that detects the type of a printing material container (ink cartridge or the like) and detects whether or not the printing material container is attached to the printing device, and that has a circuit (printing material amount detecting circuit) that detects whether or not the amount of a printing material contained in the printing material container is equal to or larger than a predetermined amount, a technique for preventing or suppressing failures (caused by a short circuit between the detecting circuit and the printing material amount detecting circuit) of the printing material container and the printing device is described in Japanese Patent No. 4539654, for example.

A short circuit protection circuit that is included in a rechargeable secondary battery pack with a function of displaying a remaining capacity is described in JP-A-5-299123, for example.

In recent years, as a printing material container (such as an ink cartridge) capable of being attached to a printing device body, a printing material container that has a storage device for storing information (for example, a remaining amount of ink) on a printing material has been used. In addition, a technique for detecting an attachment state of the ink cartridge has been used. For example, according to Japanese Patent No. 4539654, a signal that is different from a signal to be used to detect the remaining amount of the ink is supplied to an attachment detection terminal that is not a sensor terminal to be used to detect the remaining amount of the ink, and whereby the attachment of the ink cartridge is detected.

According to Japanese Patent No. 4539654, an overvoltage detection is performed to detect whether or not a short circuit is formed between the sensor terminal and the attachment detection terminal in some cases. In the overvoltage detection, a contact detection terminal that is located adjacent to a high voltage terminal (sensor terminal) to which a voltage that is higher than a normal power supply voltage (3.3 V) is applied is connected to a circuit that detects an excessive voltage and is included in a printer, and whether or not an excessive voltage occurs in the contact detection terminal is detected, for example. When the excessive voltage is detected in the contact detection terminal, the application of the high voltage to the high voltage terminal is stopped.

SUMMARY

An advantage of some aspects of the invention is that it provides a technique for ensuring a detection margin for an overvoltage detector and appropriately confirming an attachment state of a printing material container without an erroneous detection.

According to a first aspect of the invention, a printing device includes: a printing material container that can be attached to the printing device and has two first terminals, two second terminals, an electric device connected between the two first terminals, and a wiring connecting the two second terminals to each other; first and second detection terminals that contact the two first terminals when the printing material container is attached to the printing device; third and fourth detection terminals that contact the two second terminals when the printing material container is attached to the printing device; a first detection signal generator that outputs a first detection signal to the first detection terminal; a first detector that is connected to the second detection terminal; a second detection signal generator that outputs, to the third detection signal, a second detection signal that is different from the first detection signal; a second detector that is connected to the fourth detection terminal; a high voltage generator that outputs, to at least one of the first and second detection terminals, a high voltage that is higher than voltages of the first and second detection signals; an overvoltage detector that detects whether or not the high voltage has been output to at least one of the third and fourth detection terminals; and a voltage drop element that is arranged between the third or fourth detection terminal and the overvoltage detector.

According to the first aspect of the invention, the first detector detects a signal in which the first detection signal has been reflected, and the second detector detects a signal in which the second detection signal has been reflected. Thus, the printing device can detect that the printing material container is normally attached to the printing device. When the first detector detects a signal (that is not detected by the first detector in a normal state) in which the second detection signal has been reflected, the printing device can detect that a short circuit exists between the second and third detection terminals. When the second detector detects a signal (that is not detected by the second detector in the normal state) in which the first detection signal has been reflected, the printing device can detect that a short circuit exists between the first and fourth detection terminals. The overvoltage detector detects an excessive voltage that has occurred when a short circuit exists and the high voltage was applied. Thus, it is possible to quickly reduce or block the high voltage as a desired measure against the excessive voltage.

A resistance of a short circuit resistor varies depending on the cause of a short circuit. When the resistance of the short circuit resistor is large, and the first and second detection signals with relatively low voltages flow through the short circuit resistor, the voltages of the first and second detection signals are reduced. Thus, the first and second detectors may not detect short circuit signals. Even in such cases, the overvoltage detector detects an excessive voltage that has occurred when a short circuit exists and the high voltage was applied. Thus, the short circuit can be detected.

In order to quickly take measures against the excessive voltage, the overvoltage detector constantly receives a voltage. Not only when the high voltage is applied, but also when the first and second detection signals are detected, the overvoltage detector receives a voltage in which the first detection signal has been reflected and a voltage in which the second detection signal has been reflected. It is unacceptable that the overvoltage detector practically operate only upon the application of the higher voltage than the voltages of the first and second detection signals and erroneously detect, as excessive voltages, the voltages in which the first and second detection signals have been reflected.

According to the first aspect of the invention, a margin for preventing the overvoltage detector from erroneously detecting a voltage can be ensured by the voltage drop element that is arranged between the third or fourth detection terminal and the overvoltage detector. This is due to the fact that only the voltages, in which the first and second detection signals with the relatively low voltages have been reflected and which are to be input to the overvoltage detector, are reliably dropped by the voltage drop element. A voltage that is input to the overvoltage detector through a short circuit upon the application of the high voltage is originally large. Thus, even when the voltage is dropped by the voltage drop element, the voltage can be reliably detected by the overvoltage detector. The voltage drop element may be made up of one or more resistors, a voltage dividing circuit provided with a plurality of resistors, one or more diodes, a combination thereof, or the like.

According to a second aspect of the invention, in the printing device according to the first aspect of the invention, it is preferable that the first detector detect the first detection signal output from the first detection terminal through a first attachment detection path including the electric device and the two first terminals, detect contacts of the first and second detection terminals with the two first terminals, and detect a short circuit between the second and third detection terminals on the basis of the second detection signal, the second detector detect the second detection signal output from the third detection terminal through a second attachment detection path including the wiring and the two second terminals, detect contacts of the third and fourth detection terminals with the two second terminals, and detect a short circuit between the first and fourth detection terminals on the basis of the first detection signal, and the high voltage generator output the high voltage after it is determined that the detections of the first and second detectors are normal.

When the printing material container is not appropriately attached to the printing device, or when an abnormality such as a short circuit is detected, the high voltage does not need to be applied. In addition, the printing device can have a function of detecting an excessive voltage and thereby detecting a short circuit that has a high resistance and cannot be detected using the first and second detection signals with the relatively low voltages.

According to a third aspect of the invention, it is preferable that the printing device according to the second aspect of the invention further include a current limiting resistor that limits the amount of a current of the second detection signal output from the third detection terminal, wherein the voltage drop element includes a first resistor and a second resistor, the first resistor being arranged between the third or fourth detection terminal and the overvoltage detector, the second resistor being arranged between a ground and a connection node that is arranged between the first resistor and the overvoltage detector.

Since the electric device that has a higher resistance than the wiring exists in the path in which the first detection signal flows, it is preferable that the current limiting resistor that limits the amount of the current of the second detection signal be arranged in order to maintain a balance with the electric device. The voltage dividing circuit may be made up of the current limiting resistor and the first and second resistors so as to ensure the margin for preventing the overvoltage detector from erroneously detecting a voltage.

According to a fourth aspect of the invention, in the printing device according to the third aspect of the invention, it is preferable that the second detector compare a voltage of the fourth detection terminal with a first threshold and perform a detection, the overvoltage detector compare a voltage of the connection node with a second threshold and perform a detection, and resistances of the first and second resistors and a resistance of the current limiting resistor be set so that the voltage of the connection node, which is input to the overvoltage detector due to the second detection signal, is lower than the second threshold when the short circuits do not exist and the second detector compares the second detection signal with the first threshold and performs a detection.

Thus, the margin for preventing the overvoltage detector from erroneously detecting a voltage can be ensured by the first and second resistors and the current limiting resistor.

According to a fifth aspect of the invention, in the printing device according to the fourth aspect of the invention, it is preferable that the resistances of the first and second resistors and the resistance of the current limiting resistor be set so that the voltage of the connection node, which is input to the overvoltage detector on the basis of an application of the high voltage, is higher than the second threshold when a short circuit resistor has a high resistance and any of the first and second detectors cannot detect the short circuit.

Thus, the printing device can have the function of detecting an excessive voltage and thereby detecting a short circuit that has a high resistance and cannot be detected using the first and second detection signals with the relatively low voltages.

According to a sixth aspect of the invention, in the printing device according to the fifth aspect of the invention, it is preferable that when the resistances of the current limiting resistor, the first resistor and the second resistor are Rr, Ra and Rb, the first threshold is $Vi\mathbf{1}$, the second threshold is $Vi\mathbf{2}$, and a high-level voltage of the second detection signal is $V\mathbf{1}$, $V\mathbf{1}\times(Ra+Rb)/(Rr+Ra+Rb)>Vi\mathbf{1}$, and $V\mathbf{1}\times Rb/(Rr+Ra+Rb)<Vi\mathbf{2}$, and when a lower limit of voltages that are applied to connection nodes of the third and fourth detection terminals and determined as excessive voltages is $V\mathbf{2}$, $V\mathbf{2}\times Rb/(Ra+Rb)>Vi\mathbf{2}$.

Thus, the second detector can detect the second detection signal, and the overvoltage detector can detect the application of the high voltage without erroneously detecting the second detection signal.

According to a seventh aspect of the invention, it is preferable that the printing device according to the first aspect of the invention further include a switch that selects the first or second detection terminal and outputs, to the selected first or second detection terminal, the high voltage received from the high voltage generator.

Thus, when the second detection terminal and the third or fourth detection terminal are short-circuited, an excessive voltage can be detected by the overvoltage detector. In addition, when the first detection terminal and the third or fourth detection terminal are short-circuited, an excessive voltage can be detected by the overvoltage detector.

According to an eighth aspect of the invention, it is preferable that the printing device according to the first aspect of the invention further include a discharge element, wherein the electric device of the printing material container is a sensor that uses a capacitor element to detect whether or not a remaining amount of a printing material contained in the printing material container is equal to or larger than a predetermined amount, and wherein the discharge element discharges charges accumulated in the capacitor element before the output of the first and second detection signals.

When charges are accumulated in the capacitor element that serves as the sensor before a detection of a short circuit, a current that is generated due to the charges may cause an erroneous measurement. Specifically, even when the margin for preventing the overvoltage detector from erroneously detecting a voltage is provided, an increase (corresponding to remaining charges stored in the capacitor element) in a voltage may reduce the margin. To avoid this, according to the eighth aspect of the invention, the discharge element discharges the charges accumulated in the capacitor element before a contact detection by a contact detector, and whereby a reduction in the accuracy of the detection can be suppressed.

BRIEF DESCRIPTION OF THE DRAWINGS

The invention will be described with reference to the accompanying drawings, wherein like numbers reference like elements.

FIG. 5 is a block diagram illustrating a specific example of the electrical configuration that includes the board included in the cartridge according to the embodiment and the printing device according to the embodiment.

DESCRIPTION OF EXEMPLARY EMBODIMENT

Hereinafter, a preferable embodiment of the invention is described in detail. The embodiment described below does not unduly limit the contents (described in Claims) of the invention. Configurations described in the embodiment are not all necessarily essential as solving means of the invention.

Figure 1:
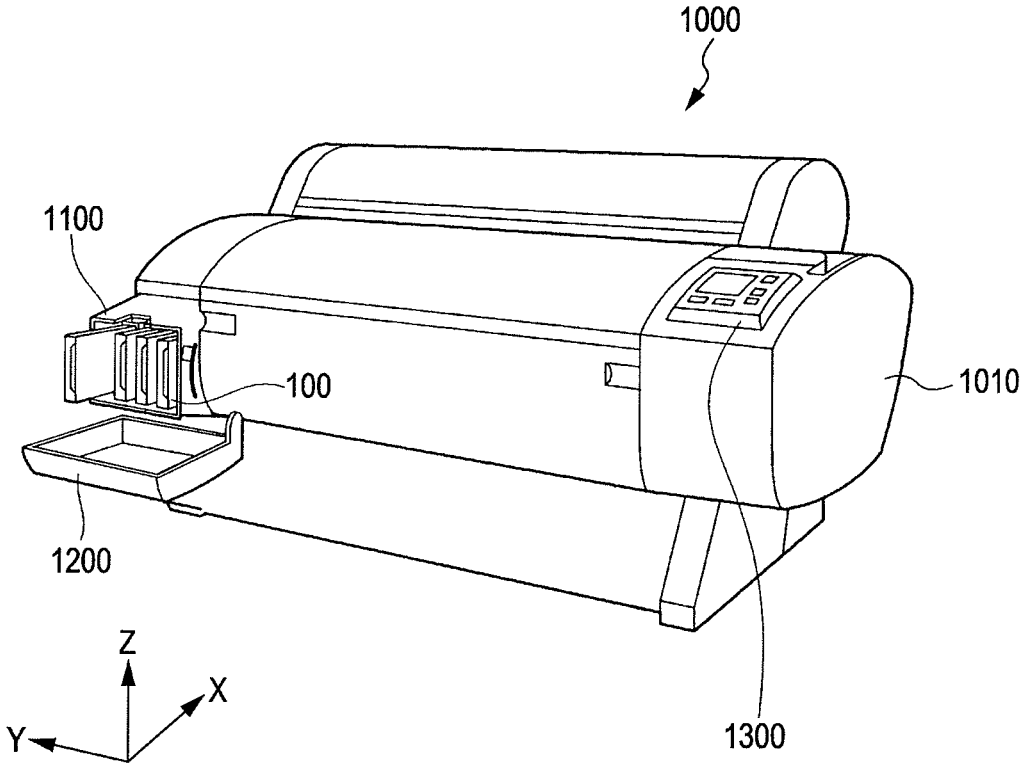
FIG. 1 is a perspective view of a configuration of a printing device according to an embodiment of the invention.

FIG. 1 is a perspective view of a configuration of a printing device 1000 according to an embodiment of the invention. The printing device 1000 includes an ink cartridge (printing material container) 100 and a device body 1010. The device body 1010 includes a cartridge attachment section 1100, a cover 1200 and an operating section 1300. The cartridge 100 is attached to the cartridge attachment section 1100. The cover 1200 is capable of rotationally moving. The cartridge attachment section 1100 is also merely called a "cartridge holder", a "holder" or an "attachment section".

In an example illustrated in FIG. 1, four ink cartridges can be independently attached to the cartridge attachment section 1100. For example, four types of ink cartridges 100 or black, yellow, magenta and cyan ink cartridges are attached to the cartridge attachment section 1100. The cover 1200 may be omitted. The operating section 1300 is an input device that is used for a user to enter various instructions and setting information. The operating section 1300 has a display unit that informs the user of various types of information.

Figure 2B:
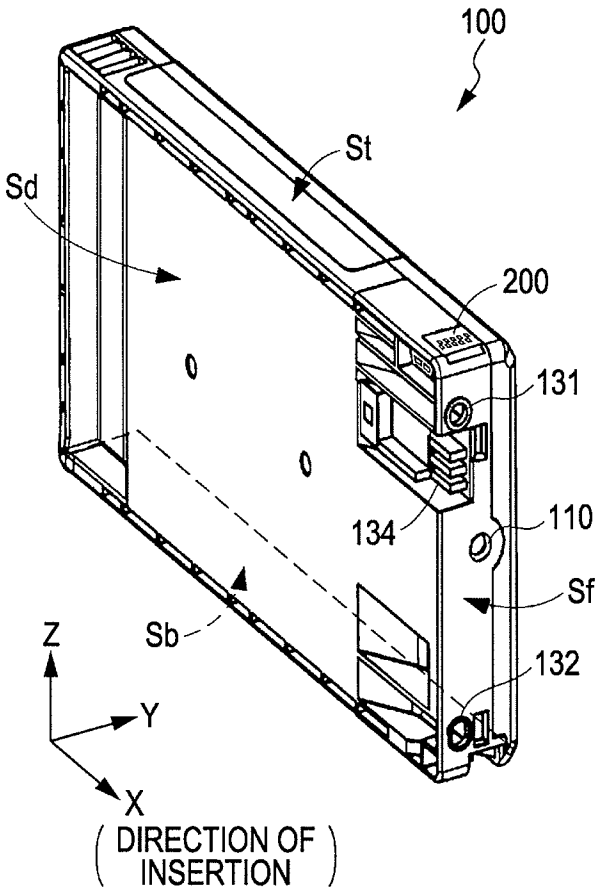
FIGS. 2A and 2B are perspective views of appearances of an ink cartridge.
Figure 2A:
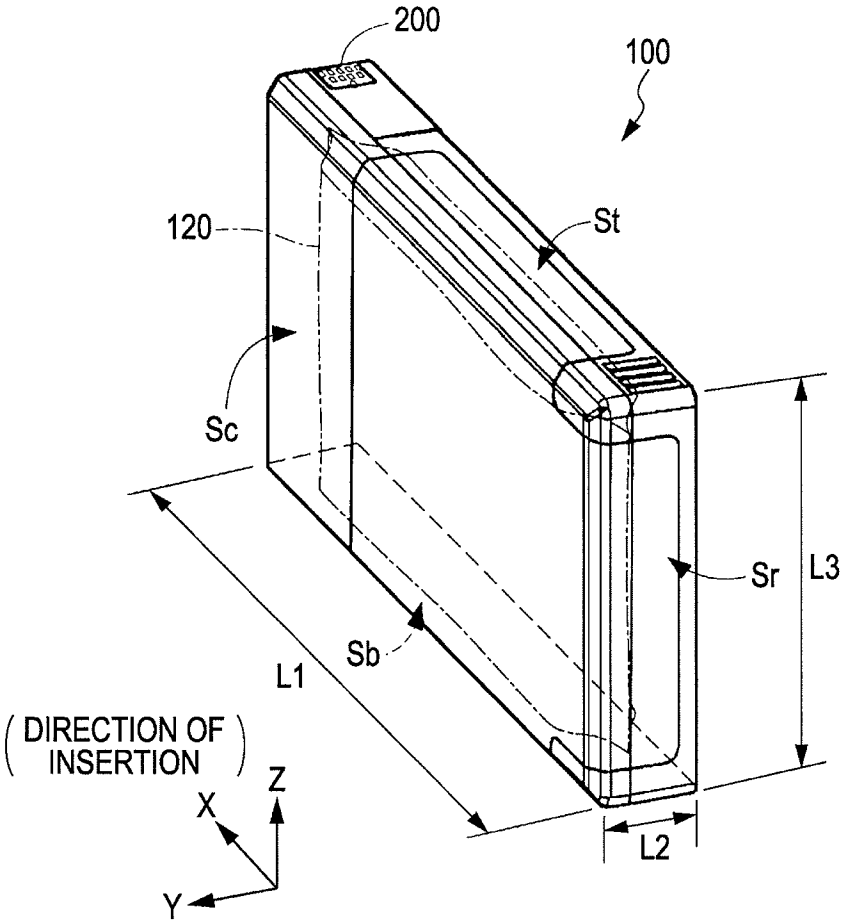

FIGS. 2A and 2B are perspective views of appearances of the printing material container (ink cartridge) 100. X, Y and Z axes illustrated in FIGS. 2A and 2B correspond to X, Y and Z axes illustrated in FIG. 1. The ink cartridge 100 is also merely called a "cartridge". The cartridge 100 is formed in a flat and substantially cuboid shape. The cartridge 100 has a length L1, a width L2 and a height L3 in three directions. The length L1 (size in a direction in which the cartridge 100 is inserted into the printing device 1000) is largest. The width L2 is smallest. The height L3 is larger than the width L2 and smaller than the length L1.

The cartridge 100 has a front surface (first surface) Sf, a back surface (second surface) Sr, a ceiling surface (third surface) St, a bottom surface (fourth surface) Sb and first and second side surfaces (fifth and sixth surfaces) Sc and Sd. The cartridge 100 has therein an ink storage chamber 120 (also called "ink storage bag") made of a flexible material. The front surface Sf has two positioning holes 131 and 132 and an ink supply port 110. A circuit board 200 is arranged on the ceiling surface St. A nonvolatile storage device 203 for storing information on ink is mounted on the circuit board 200. The first and second side surfaces Sc and Sd face each other and are perpendicular to the front surface Sf, the ceiling surface St, the back surface Sr and the bottom surface Sb. The cartridge 100 has a concavo-convex engagement section 134 arranged at a position at which the second side surface Sd and the front surface Sf intersect each other.

Figure 3A:
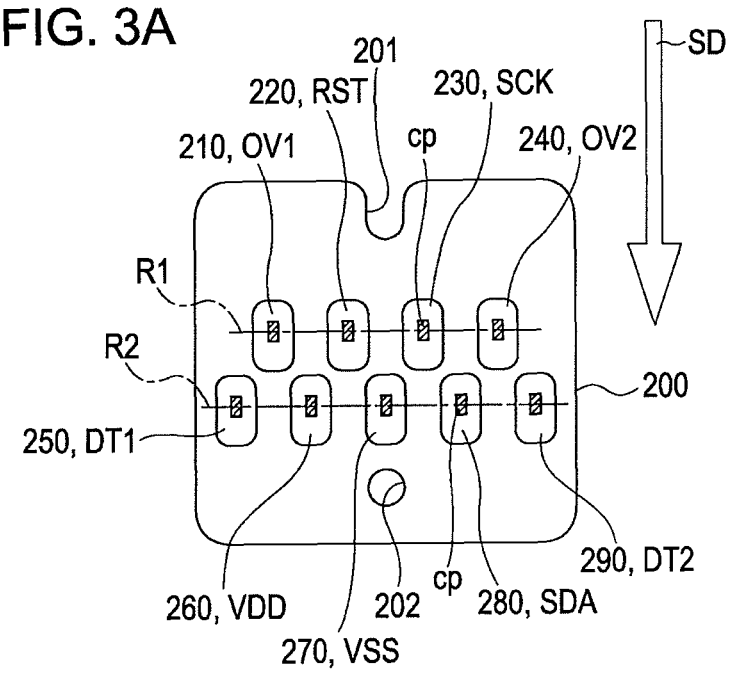
FIGS. 3A and 3B are diagrams illustrating a configuration of a surface of a board and illustrating a configuration of the board when the board is viewed from a side surface of the board.
Figure 3B:
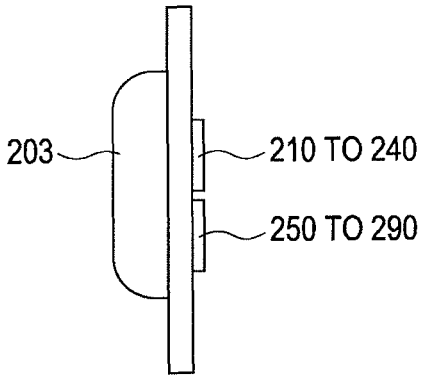

FIG. 3A illustrates a configuration of the circuit board (hereinafter referred to as board) 200 according to the embodiment. A surface of the board 200 is exposed to the outer side of the cartridge 100 when the board 200 is attached to the cartridge 100. FIG. 3B is a diagram illustrating the board 200 when the board 200 is viewed from a side surface of the board 200. The board 200 has a boss groove 201 at an upper end portion of the board 200. The board 200 has a boss hole 202 at a lower end portion of the board 200.

An arrow SD illustrated in FIG. 3A indicates a direction in which the cartridge 100 is attached to the cartridge attachment section 1100. The direction SD matches a direction (X direction) in which the cartridge 100 illustrated in FIGS. 2A and 2B is attached to the cartridge attachment section 1100. The board 200 has the storage device 203 mounted on a back surface of the board 200. The board 200 has a terminal group of nine terminals 210 to 290 mounted on the front surface of the board 200, for example. The storage device 203 stores the information (for example, a remaining amount of the ink) on the ink of the cartridge 100. The terminals 210 to 290 are each formed in a substantially rectangular shape. The terminals 210 to 290 are arranged in two rows that are substantially perpendicular to the direction SD.

A row (located on the upper side of FIG. 3A) that is among the two rows and located on the side opposite to the side on which the cartridge 100 is attached to the cartridge attachment section 1100 is called an upper row R1 (first row). The other row (located on the lower side of FIG. 3A) that is among the two rows and located on the side on which the cartridge 100 is attached to the cartridge attachment section 1100 is called a lower row R2 (second row). It can be considered that the rows R1 and R2 are rows formed by contact portions cp (that contact terminals (described later) of the printing device 1000) of the terminals 210 to 290.

The terminals 210 to 240 form the upper row R1, while the terminals 250 to 290 form the lower row R2. The terminals 210 to 290 have the following functions (or are used for purposes described below).

Upper Row R1

(1) Attachment detection terminal (second terminal) 210

(2) Reset terminal 220
(3) Clock terminal 230
(4) Attachment detection terminal (second terminal) 240
Lower Row R2
(5) Attachment detection terminal (first terminal, or sensor terminal) 250
(6) Power supply terminal 260
(7) Ground terminal 270
(8) Data terminal 280
(9) Attachment detection terminal (first terminal, or sensor terminal) 290

The four attachment detection terminals 210, 240, 250 and 290 are used to detect whether or not electrical contacts of the attachment detection terminals 210, 240, 250 and 290 with detection terminals 510, 540, 550 and 590 (corresponding to the attachment detection terminals 210, 240, 250 and 290) of the device body 1010 are excellent. The four attachment detection terminals 210, 240, 250 and 290 may be also called "contact detection terminals". A process of detecting an attachment may be also called a "contact detection process". In the embodiment, the four attachment detection terminals 210, 240, 250 and 290 are used to detect the attachment and a short circuit. The attachment detection terminals 210 and 240 are also used to detect an excessive voltage. The attachment detection terminals 250 and 290 are also called two "first terminals", while the attachment detection terminals 210 and 240 are also called two "second terminals". The attachment detection terminals 250 and 290, which are among the attachment detection terminals, are connected to a sensor 208 (described later) and also called sensor terminals. The other five terminals 220, 230, 260, 270 and 280 are terminals for the storage device 203 and also called "memory terminals".

The plurality of terminals 210 to 290 include contact portions cp, respectively, while the contact portions cp contact terminals that correspond to the contact portions cp and are included in the device body 1010. The contact portions cp of the terminals 210 to 240 that form the upper row R1, and the contact portions cp of the terminals 250 to 290 that form the lower row R2, are alternately arranged and form a so-called zigzag arrangement. The terminals 210 to 240 that form the upper row R1, and the terminals 250 to 290 that form the lower row R2, are alternately arranged and form a so-called zigzag arrangement so that the centers of the terminals 210 to 240 that form the upper row R1, and the centers of the terminals 250 to 290 that form the lower row R2, are not arranged in the direction SD.

The contact portions cp of the attachment detection terminals 210 and 240 of the upper row R1 are arranged at both ends of the upper row R1 or arranged on the outermost sides of the upper row R1. The contact portions cp of the attachment detection terminals 250 and 290 of the lower row R2 are arranged at both ends of the lower row R2 or arranged on the outermost sides of the lower row R2. The contact portions of the memory terminals 220, 230, 260, 270 and 280 are arranged in a substantially central part of a region in which the plurality of terminals 210 to 290 are arranged. The contact portions cp of the four attachment detection terminals 210, 240, 250 and 290 are arranged at four corners of a region in which the memory terminals 220, 230, 260, 270 and 280 are arranged.

Figure 4:
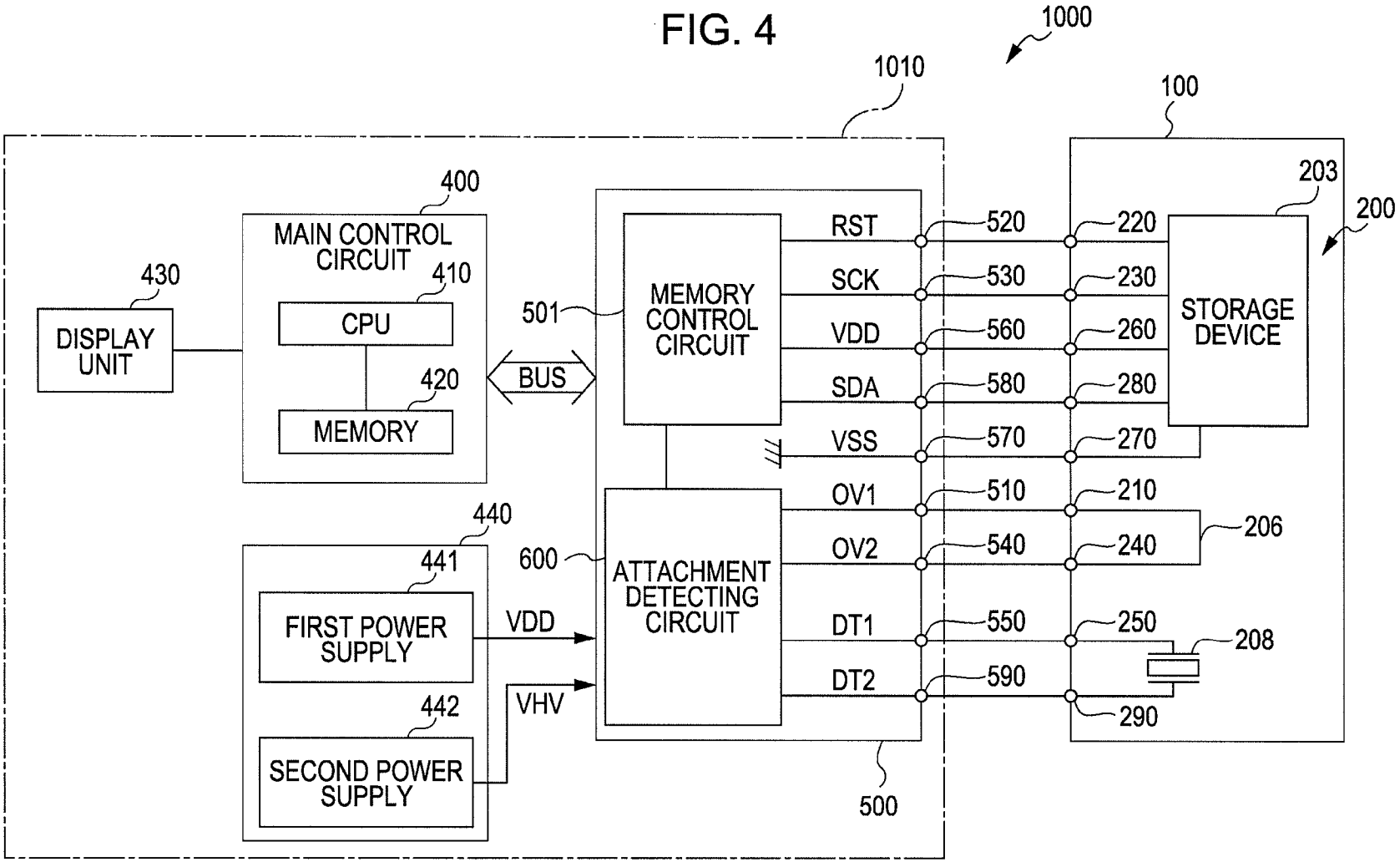
FIG. 4 is a block diagram illustrating an electrical configuration that includes the board included in a cartridge according to the embodiment and the printing device according to the embodiment.

FIG. 4 is a block diagram illustrating an electrical configuration that includes the board 200 of the cartridge 100 according to the embodiment and the device body 1010. The device body 1010 of the printing device 1000 includes a display panel 430, a power supply circuit 440, a main control circuit 400 and a sub-control circuit 500. The display panel 430 is the display unit that informs the user of various types of information such as an operational state of the printing device 1000 and an attachment state of the cartridge 100. The display panel 430 is included in the operating section 1300 (illustrated in FIG. 1), for example. The power supply circuit 440 includes a first power supply 441 and a second power supply 442. The first power supply 441 generates a first power supply voltage VDD. The second power supply 442 generates a second power supply voltage VHV.

The first power supply voltage VDD is a normal power supply voltage (rated voltage of 3.3 V) that is used for a logic circuit. The second power supply voltage VHV is a high voltage (for example, a rated voltage of 42 V) that is used to drive a print head and eject ink. The first and second power supply voltages VDD and VHV are supplied to the sub-control circuit 500. In addition, the first and second power supply voltages VDD and VHV are supplied to another circuit when necessary. The main control circuit 400 includes a CPU 410 and a memory 420. The sub-control circuit 500 includes a memory control circuit 501 and an attachment detecting circuit 600. The memory control circuit 501 accesses the storage device 203 of the cartridge 100. A circuit that includes the main control circuit 400 and the sub-control circuit 500 may be also called a "control circuit (controller)".

The device body 1010 of the printing device 1000 has a plurality of terminals 510 to 590 that are connected to the sub-control circuit 500. The terminals 510 to 590 of the device body 1010 contact the terminals 210 to 290 of the printing material container (ink cartridge) 100, respectively. The terminals 550 and 590 are called first and second detection terminals 550 and 590 that are connected to the two first terminals 250 and 290 of the cartridge 100, respectively. The first and second detection terminals 550 and 590 are also sensor terminals that are included in the printing device 1000 and supply sensor driving signals to the sensor terminals 250 and 290, respectively. The terminals 510 and 540 are called third and fourth detection terminals 510 and 540 that contact the second terminals 210 and 240 of the cartridge 100, respectively.

The reset terminal 220, the clock terminal 230, the power supply terminal 260, the ground terminal 270 and the data terminal 280, which are among the nine terminals mounted on the board 200 (illustrated in FIG. 3) of the cartridge 100, are electrically connected to the storage device 203. The storage device 203 is a nonvolatile memory. A memory cell that is included in the storage device 203 and is to be accessed is determined on the basis of the number of pulses of a clock signal SCK input to the storage device 203 from the clock terminal 230 and command data input to the storage device 203 from the data terminal 280. The storage device 203 is synchronized with the clock signal SCK and receives data through the data terminal 280 from the sub-control circuit 500 or transmits data through the data terminal 280 to the sub-control circuit 500. The clock terminal 230 is used to supply the clock signal SCK from the sub-control circuit 500 through the terminal 530 of the printing device 1000 to the storage device 203. A power supply voltage (for example, 3.3 V) that is used to drive the storage device 203 is supplied from the printing device 1000 to the power supply terminal 260 through the terminal 560 of the printing device 1000. A ground voltage (0 V) is supplied from the printing device 1000 to the ground terminal 270 through the terminal 570 of the printing device 1000.

The power supply voltage that is used to drive the storage device 203 may be a voltage directly provided from the first power supply voltage VDD or may be a voltage that is generated from the first power supply voltage VDD and lower than the first power supply voltage VDD. The data terminal 280 is used to transmit and receive a data signal SDA between the sub-control circuit 500 and the storage device 203 through the terminal 580 of the printing device 1000. The reset terminal 220 is used to supply a reset signal RST from the sub-control circuit 500 to the storage device 203 through the terminal 520 of the printing device 1000. The two attachment detection terminals (two second terminals) 210 and 240 are connected to each other through a wiring 206 on the board 200 (illustrated in FIG. 3) of the cartridge 100. When the third and fourth detection terminals 510 and 540 contact the second terminals 210 and 240, respectively, the third and fourth detection terminals 510 and 540 are connected to each other through the wiring 206. The other two attachment detection terminals (two first terminals) 250 and 290 are connected to an electric device (for example, the sensor 208) included in the cartridge 100. The first terminals 250 and 290 that are included in the cartridge 100 also function as sensor terminals and contact the first and second detection terminals 550 and 590 of the printing device 1000, respectively.

In order for the sensor 208 to detect a remaining amount of ink, liquid amount inspection signals are supplied through the sensor terminals 250 and 290 to electrodes of a piezoelectric element that forms the sensor 208. The liquid amount inspection signals are analog signals that are generated by a high voltage generator 661 (refer to FIG. 5) and whose maximum voltages are, for example, approximately 36 V. The liquid amount inspection signals are supplied to the sensor terminals 250 and 290 so that the maximum of the difference between voltages of the sensor terminals 250 and 290 is 36 V. The piezoelectric element that forms the sensor 208 vibrates on the basis of the remaining amount of the ink contained in the cartridge 100. A counter electromotive voltage is generated due to the vibration and supplied as a liquid amount response signal from the piezoelectric element through the sensor terminals 250 and 290 to a liquid amount detector 664 (refer to FIG. 5). The liquid amount response signal includes a vibration component that has a frequency corresponding to the frequency of the vibration of the piezoelectric element. The liquid amount detector 664 measures the frequency of the liquid amount response signal and thereby detects whether or not the remaining amount of the ink is equal to or larger than a predetermined amount. The process of detecting the remaining amount of the ink is performed through a process of supplying, through the terminal 250 to the sensor 208, a high voltage signal that has a higher voltage level than a first attachment detection signal SPins that is used for a leakage inspection (leakage detection process) described later.

Any of the sensor terminals 250 and 290 is connected to a ground GND through a discharge element M1 or M4 (illustrated in FIGS. 8 and 9 and described later) so that a voltage of the sensor driving signal is supplied to the sensor terminal 250 or 290 connected to the ground GND.

FIG. 5 is a block diagram illustrating a specific example of the electrical configuration that includes the boards 200 of the cartridges 100 according to the embodiment and the device body 1010. FIG. 5 illustrates only two of the four color ink cartridges 100 (illustrated in FIG. 1).

The printing device 1000 illustrated in FIG. 5 receives printing materials (ink or the like) from the printing material containers (ink cartridges) IC1 and IC2 and performs printing. The printing material containers IC1 and IC2 store the printing materials and can be attached to the printing device 1000.

A sensor processing unit 660 has two attachment/short circuit detectors 662 and 665. The attachment/short circuit detectors 662 and 665 are used to detect whether or not the printing material containers (ink cartridges) IC1 and IC2 have been normally attached to the printing device 1000. The attachment/short circuit detectors 662 and 665 are used to detect whether or not an abnormal short circuit exists between the first and fourth detection terminals 550 and 540 and whether or not an abnormal short circuit exists between the second and third detection terminals 590 and 510. The first and fourth detection terminals 550 and 540 are not originally connected to each other. The second and third detection terminals 590 and 510 are not originally connected to each other. In addition, the attachment/short circuit detectors 662 and 665 are used to detect whether or not an excessive voltage has occurred due to at least one of the short circuits.

The short circuits to be detected include all short circuits that cause the third detection terminal 510 from which a second attachment detection signal (second detection signal) DPins illustrated in FIG. 5 is output when the sensor processing unit (sensor driving circuit) 660 applies the high voltage to the sensor 208) and the second terminal device 590 (connected to a first detector 667) to be consequently electrically connected to each other and that cause the first detection terminal 550 (from which the first attachment detection signal (first detection signal) SPins illustrated in FIG. 5 is output) and the fourth detection terminal 540 (connected to a second detector 670) to be consequently electrically connected to each other. The short circuits are accidentally formed due to an attachment of ink or the like. In other words, the short circuits to be detected are short circuits that cause high voltages (to be originally applied to the sensor terminals 250, 290, 550 and 590) to be applied to a terminal other than the sensor terminals 250, 290, 550 and 590 and thereby cause a higher voltage than an absolute maximum rated voltage of the storage device 203 to be applied to the storage device 203 or cause a higher voltage than an absolute maximum rated voltage of the sub-control circuit 500 to be applied to the sub-control circuit 500.

The two attachment/short circuit detectors 662 and 665 that are included in the sensor processing unit 660 illustrated in FIG. 5 correspond to the attachment detecting circuit 600 illustrated in FIG. 4.

(1) Attachment Detection (Contact Detection)

The attachment/short circuit detector 662 includes a first detection signal generator 640 and the first detector 667. The attachment/short circuit detector 665 includes a second detection signal generator 650 and the second detector 670.

The first detection signal generator 640 generates the first detection signal SPins. The first detection signal SPins is at a high level H1 for a first time period P11 illustrated in FIG. 6. The first detection signal SPins is at a low level for a second time period P12 that succeeds the first time period P11. When the first and second detection terminals 550 and 590 are in contact with the terminals 250 and 290 of the ink cartridge IC1, respectively, the first detection signal SPins that is generated by the first detection signal generator 640 is detected by the first detector 667 through the following path. That is, the first detection signal SPins that is generated by the first detection signal generator 640 flows through an output buffer A1 (illustrated in FIG. 5), a switch TS1, a switch SW1 (contact point a1), the first detection terminal 550, the ink cartridge IC1 (the first terminal 250, the sensor 208 and the first terminal 290), the second detection terminal 590, a switch SW2 (contact point b1) and an input buffer A2, which form the path (first attachment detection path), so that a first detection response signal SPres is detected by the first detector 667. It should be noted that the high level H1 of the first detection signal SPins is set to a voltage of 3.3 V, for example.

Figure 6:
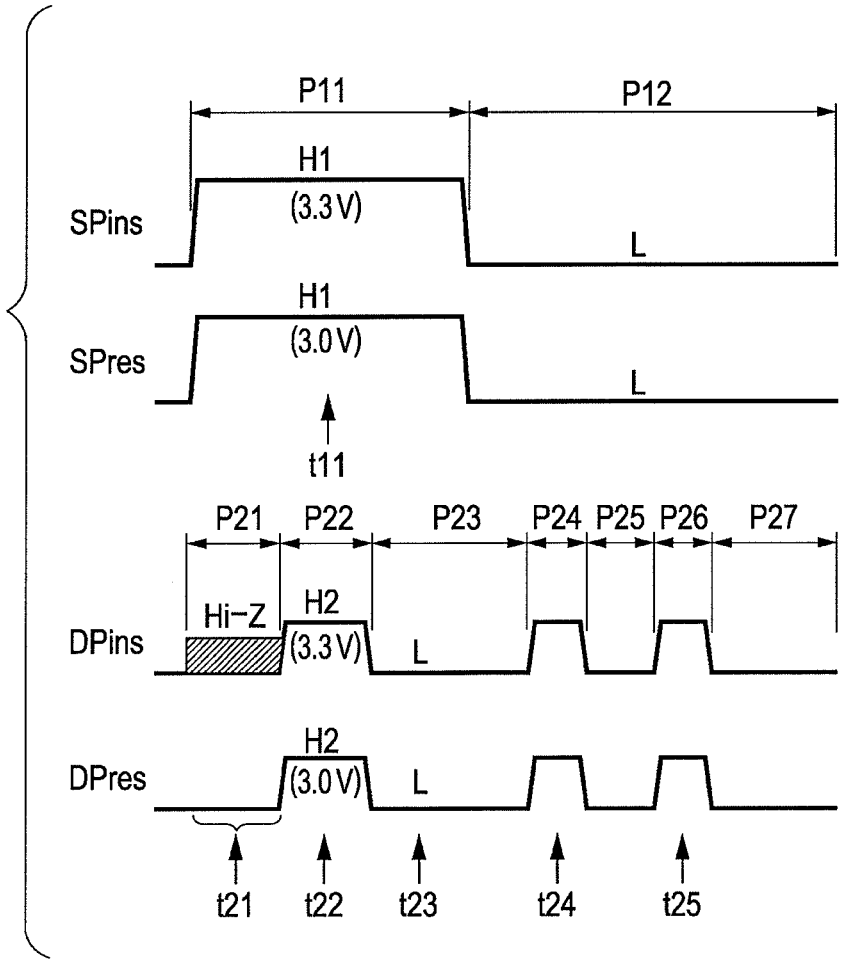
FIG. 6 is a timing chart of signals that are used in an attachment detection process.

When the sensor 208 that is an example of the electric device is a capacitor element, a voltage that is applied to one of both ends of the sensor 208 is generated at the other end of the sensor 208 due to capacity coupling. Since the voltage of the first detection signal SPins is transferred through the sensor 208, the first detection response signal SPres that is based on the first detection signal SPins can be detected by the first detector 667. When the first and second detection terminals 550 and 590 are normally in contact with the terminals 250 and 290 of the ink cartridges IC1, respectively, the voltage of the first detection response signal SPres is reduced from 3.3 V to 3.0 V, but changes in a manner that is the same as or similar to a voltage of the first attachment detection signal SPins as illustrated in FIG. 6, for example.

Figure 7A:
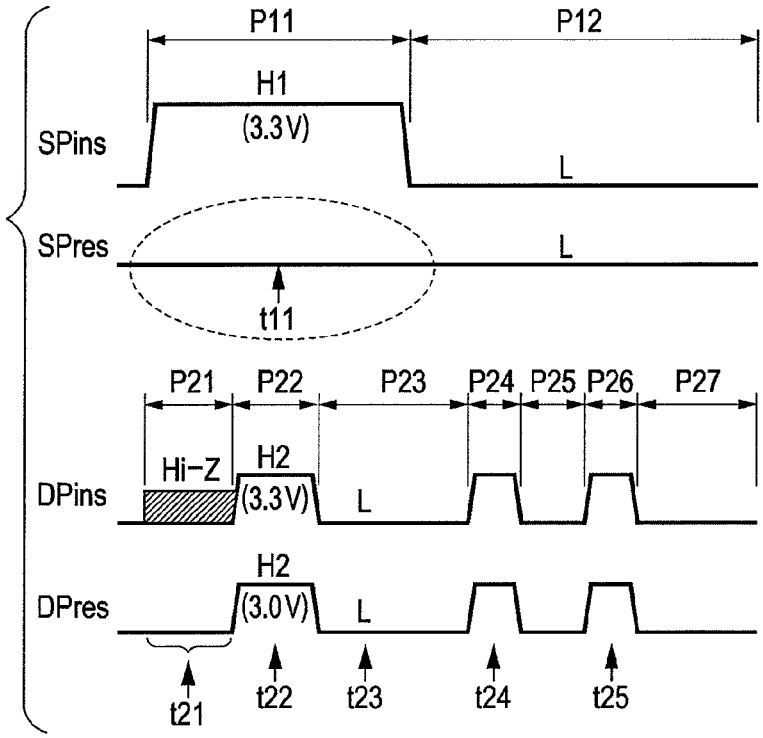
FIGS. 7A and 7B are timing charts of typical waveforms of signals that are formed when contact failures occur.

When the first and second detection terminals 550 and 590 do not normally contact the first terminals 250 and 290 of the ink cartridge IC1, the first attachment detection path is not established. In this case, the first detection response signal SPres that is based on the first detection signal SPins is not detected by the first detector 667 (refer to FIG. 7A). Thus, the first detector 667 determines, at a time t11 illustrated in FIGS. 6 and 7A, whether to detect the first detection response signal SPres and can thereby detects, with high accuracy, whether or not the first and second detection terminals 550 and 590 contact the first terminals 250 and 290, respectively.

In order to inspect the other ink cartridge IC2, a switch SW1' (contact point a1') and a switch SW2' (contact point b1') are used instead of the aforementioned switches SW1 and SW2. Thus, the plurality of ink cartridges IC1 and IC2 can be inspected at different times.

The second detection signal generator 650 generates the second detection signal DPins. As illustrated in FIG. 6, the second detection signal DPins is divided into parts corresponding to seven time periods P21 to P27, for example. Specifically, the second detection signal DPins is in a high impedance state for the time period P21. The second detection signal DPins is at a high level H2 for the time periods P22, P24 and P26. The second detection signal DPins is at a low level L for the time periods P23, P25 and P27. The high level H2 of the second detection signal DPins is set to a voltage of 3.3 V. The first and second time periods P21 and P22 of the second detection signal DPins correspond to a part of the time period P11 of the first detection signal SPins. The fourth to seventh time periods P24 to P27 of the second detection signal DPins correspond to a part of the second time period P12 of the first detection signal SPins.

When all the third and fourth detection terminals 510 and 540 that are connected to the ink cartridges IC1 and IC2 contact the second terminals 210 and 240 that correspond to the third and fourth detection terminals 510 and 540 and are included in the ink cartridges IC1 and IC2, the second detection signal DPins that is generated by the second detection signal generator 650 is detected by the second detector 670 through the following path. That is, the second detection signal DPins that is generated by the second detection signal generator 650 flows through an output buffer A3 (illustrated in FIG. 5), a resistor Rr, the third detection terminals 510, the ink cartridges IC1 and IC2 (the second terminals 210, the wirings 206 and the second terminals 240), the fourth detection terminals 540 and an input buffer A4, which form the path (second attachment detection path), so that a second detection response signal DPres is detected by the second detector 670.

When the second terminals 210 and 240 of all the cartridges IC1 and IC2 are normally in contact with the third and fourth detection terminals 510 and 540, the second detection response signal DPres is at the low level for the first time period P21 and changed to levels in a manner that is the same as or similar to the second detection signal DPins for the time periods P22 to P27, as illustrated in FIG. 6. The reason that the second detection response signal DPres is at the low level for the first time period P21 is that the second detection response signal DPres that flows in an input wiring L1 arranged between the second detector 670 and the fourth detection terminals 540 is at the low level immediately before the first time period P21.

Figure 7B:
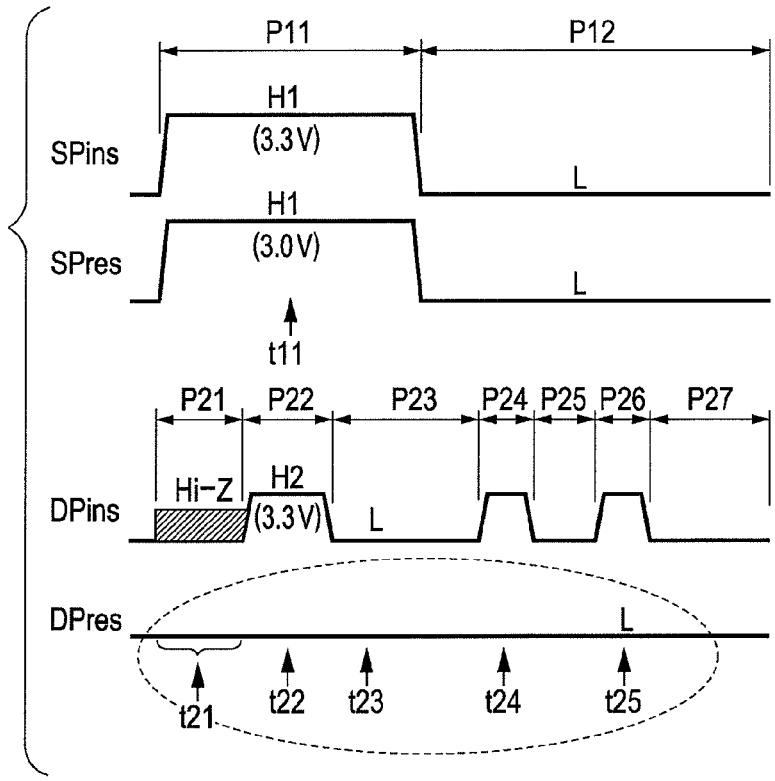

When any of the third and fourth detection terminals 510 and 540 does not contact the second terminal 210 or 240, the second attachment detection path is not established. In this case, the second detection response signal DPres that is based on the second detection signal DPins is not detected by the second detector 670 (refer to FIG. 7B). Thus, the second detector 670 determines, at times (illustrated in FIG. 7B) t22, t24 and t25 (set within the time periods P22, P24, P25, respectively), whether to detect the second detection response signal DPres and thereby detects, with high accuracy, whether or not the third and fourth detection terminals 510 and 540 contact the second terminals 210 and 240, respectively.

(2) Detection of Short Circuit

Figure 8:
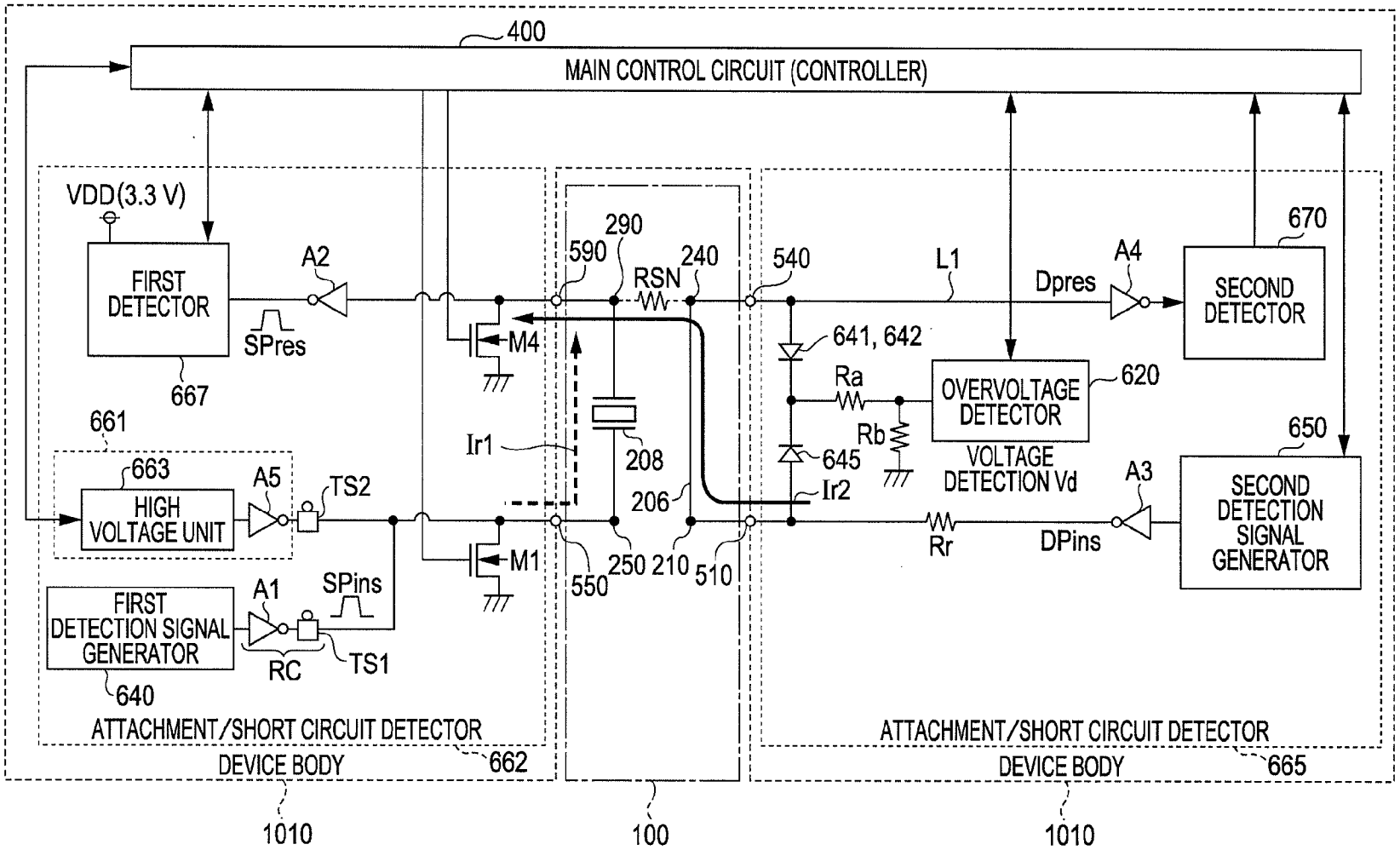
FIG. 8 is a diagram explaining a short circuit detection operation that is performed when a short circuit is formed between terminals due to a short circuit resistor.
Figure 9:
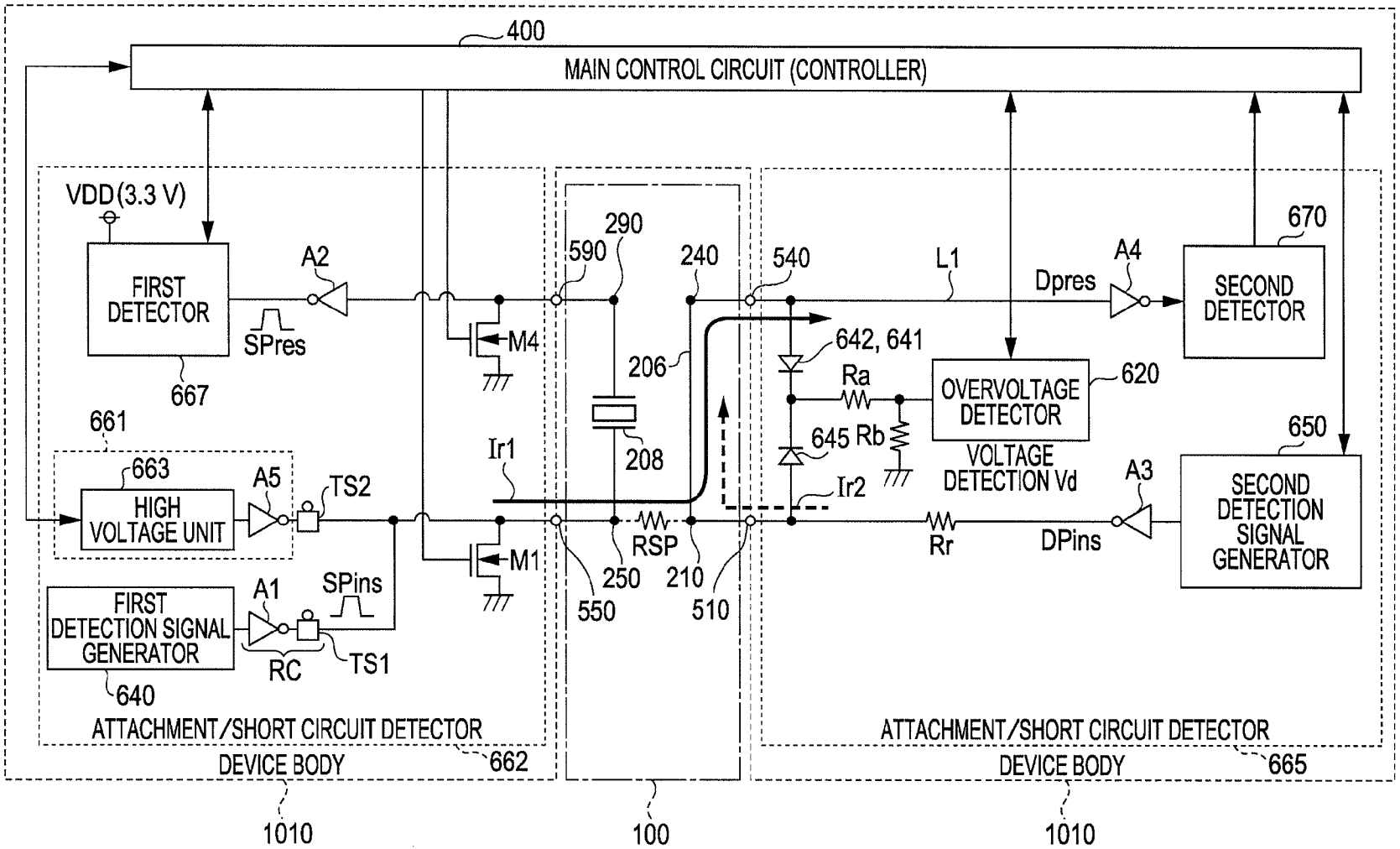
FIG. 9 is a diagram explaining a short circuit detection operation that is performed when a short circuit is formed between terminals due to another short circuit resistor.

In the present embodiment, the first and second detection signal generators 640 and 650 and the first and second detectors 667 and 670 are used so that a short circuit, which is formed between terminals and may cause a higher voltage than the absolute maximum rated voltage of the storage device 203 or sub-control circuit 500 to be applied to the storage device or the sub-control circuit 500, is detected. The detection of the short circuit is described below with reference to FIGS. 8 to 10B. In FIGS. 8 and 9, only one cartridge 100 is illustrated for convenience of the illustration.

FIG. 8 is a diagram explaining an operation to be performed when an electrical short circuit exists between the second detection terminal 590 and the third detection terminal 510. When the electrical short circuit exists between the second detection terminal 590 and the third detection terminal 510, the third detection terminal 510 (from which the second attachment detection signal (second detection signal) DPins illustrated in FIG. 5 is output) and the second detection terminal 590 (connected to the first detector 667) are consequently electrically connected to each other. The electrical short circuit that exists between the second detection terminal 590 and the third detection terminal 510 may be a short circuit between the terminals 240 and 290 of the cartridge 100 or may be a short circuit between the second and fourth detection terminals 590 and 540 of the device body 1010.

In this case, the first detector 667 receives not only the first detection signal SPins (Ir1) (that has flowed through the first attachment detection path) but also a signal obtained by combining the first detection signal SPins (Ir1) and the second detection signal DPins that has flowed through a first short circuit path Ir2 (including the resistor Rr, the third detection terminal 510, the cartridge (the second terminal 210, the wiring 206 and second terminal 240), a first short circuit resistor RSN and the second detection terminal 590). The first detector 667 can detect the short circuit between the second detection terminal 590 and the third detection terminal 510 on the basis of the received signals.

FIG. 9 is a diagram explaining an operation to be performed when an electrical short circuit exists between the first detection terminal 550 and the fourth detection terminal 540. When the electrical short circuit exists between the first detection terminal 550 and the fourth detection terminal 540, the first detection terminal 550 (from which the first attachment detection signal (first detection signal) SPins is output) and the fourth detection terminal 540 (connected to the second detector 670) are consequently electrically connected to each other. The electrical short circuit that exists between the first detection terminal 550 and the fourth detection terminal 540 may be a short circuit between the terminals 210 and 250 of the cartridge 100 or may be a short circuit between the first and third detection terminals 550 and 510 of the device body 1010.

In this case, the second detector 670 receives not only the second detection signal DPins (Ir2) (that has flowed through the second attachment detection path) but also a signal obtained by combining the second detection signal DPins (Ir2) and the first detection signal SPins that has flowed through a second short circuit path Ir1 (including a resistor Rc, the first detection terminal 550, a first short circuit resistor RSP, the cartridge (the second terminal 210, the wiring 206 and the second terminal 240) and the forth detection terminal 540) including a second short circuit section (short circuit resistor RSP) located between the first detection terminal 550 and the third detection terminal 510 (fourth detection terminal 540). Thus, the second detector 670 can detect the short circuit between the first and fourth detection terminals 550 and 540 on the basis of the received signals.

Figure 10A:
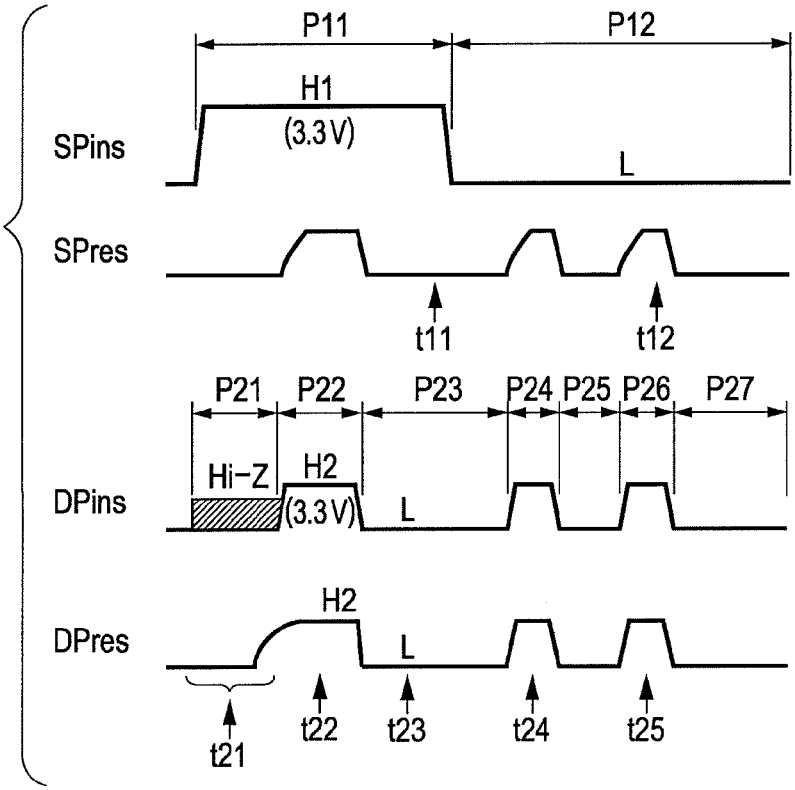
FIGS. 10A and 10B are timing charts of typical waveforms of the signals when the short circuits described with reference to FIGS. 8 and 9 are formed.

The detections of the short circuits are described below with reference to FIGS. 10A and 10B. FIG. 10A illustrates waveforms when the terminals 240 and 290 of the cartridge 100 are short-circuited in the same manner as illustrated in FIG. 8 and whereby the second and third detection terminals 590 and 510 are short-circuited. In this case, the waveform of the second detection signal DPins is reflected in the first detection response signal SPres that is detected by the first detector 667 as illustrated in FIG. 10A. When the first detection signal SPins is at the high level and the first detection response signal SPres is at the high level at the time t11, the first detection response signal SPres is normal. When the second detection signal DPins is reflected in the first detection response signal SPres and the first detection response signal SPres is at the low level at the time t11 as illustrated in FIG. 10A, it can be determined that the first detection response signal SPres is abnormal. When the first detection signal SPins is at the low level and the first detection response signal SPres is at the low level at the time t12, the first detection response signal SPres is normal. When the second detection signal DPins is reflected in the first detection response signal SPres and the first detection response signal SPres is at the high level at the time t12 as illustrated in FIG. 10A, it can be determined that the first detection response signal SPres is abnormal.

Figure 10B:
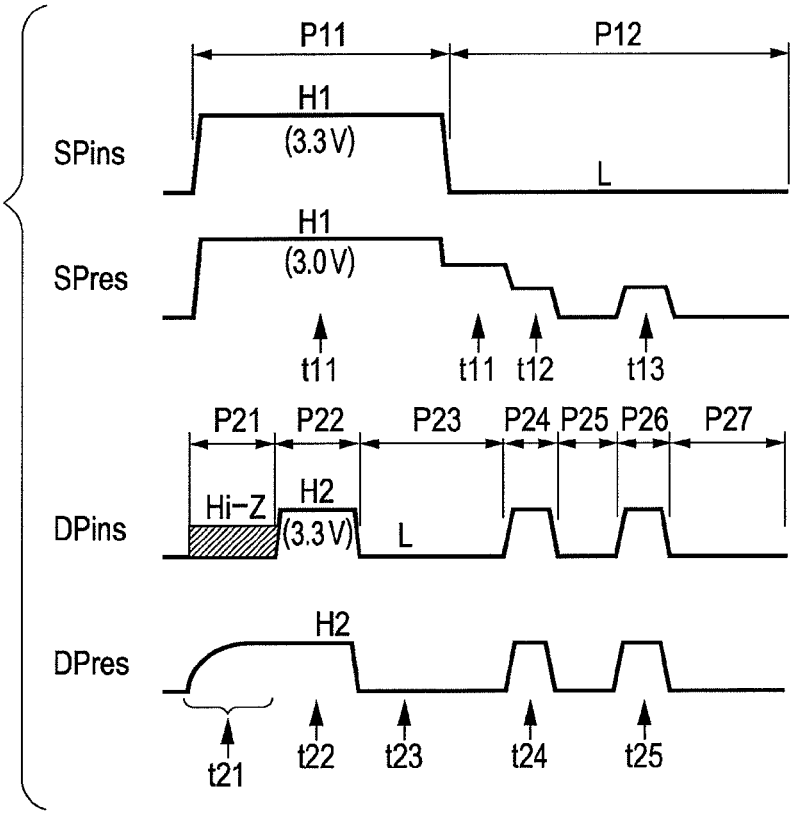

FIG. 10B illustrates waveforms when the terminals 210 and 250 of the cartridges 100 are short-circuited in the same manner as illustrated in FIG. 9 and whereby the first and fourth detection terminals 550 and 540 are short-circuited. In this case, the level of the first detection response signal SPres detected by the first detector 667 is not constant at times t11, t12 and t13 due to the short circuits, as illustrated in FIG. 10B. The waveform of the first detection signal SPins is reflected in the second detection response signal DPres (to be detected by the second detector 670) at a time t21 (illustrated in FIG. 10B). In the present embodiment, when the second detection signal DPins is at the low level and the second detection response signal DPres is at the low level at the time t21, the second detection response signal DPres is normal. When the second detection response signal DPres is at the high level at the time t21 as illustrated in FIG. 10B, it can be determined that the second detection response signal DPres is abnormal.

The contact detection and the short circuit detection are performed in a sequence that is performed when a power supply of the printing device 1000 is turned on and when a cartridge is replaced. The contact detection and the short circuit detection are performed before the detection of the amounts of the ink. When a short circuit is detected during the contact detection that is performed to detect whether or not the cartridge 100 has been normally attached to the holder 1100, it is preferable that the detection of the amounts of the ink be not performed and it is preferable to prompt the user to replace the cartridge 100 or display a message that prompts the user to remove a stain or the like from the cartridge 100.

(3) Detection of Excessive Voltage

Next, the detection of an excessive voltage that occurs when at least one of the aforementioned short circuits exists is described. The detection is a process of preventing the high voltage for driving the sensor 208 from being supplied to the sub-control circuit 500 and the storage device 203 due to at least one of the short circuits that are not detected during the attachment detection and are formed before the process of detecting the amounts of the ink. As illustrated in FIGS. 5, 8 and 9, the attachment/short circuit detector 662 has the high voltage generator 661, while the attachment/short circuit detector 665 has an overvoltage detector 620.

The high voltage generator 661 generates the high voltage (for example, 36 V) that is higher than the voltages (for example, 3.3 V) of the first and second detection signals SPins and DPins. The high voltage generator 661 (including a high voltage unit 663 and an output buffer A5) applies the high voltage (for example, 36 V) to the sensor 208 through the switch TS2. The liquid amount detector 664 (illustrated in FIG. 5) detects remaining amounts of the ink contained in the ink cartridges IC1 and IC2.

When the high voltage is applied and a short circuit occurs through at least one of the short circuit resistor RSN (illustrated in FIG. 8) and the short circuit resistor RSP (illustrated in FIG. 9), the high voltage is divided by a voltage dividing circuit (including a resistor Ra and a resistor Rb) through at least one of the short circuit resistors RSN and RSP, at least one of the third and fourth detection terminals 510 and 540, and at least one of diodes 641, 642 and 645 (illustrated in FIG. 5). The divided voltage is detected by the overvoltage detector 620.

When a short circuit exists between any of the sensor terminals 250, 290, 550 and 590 and any of the terminals 210, 240, 510 and 540 (other than the sensor terminals) and a voltage that is higher than a predetermined voltage is applied to any of the terminals 210, 240, 510 and 540, the overvoltage detector 620 detects the occurrence of the excessive voltage. In this case, the overvoltage detector 620 transmits the result of the detection to the main control circuit (controller) 400, for example. The main control circuit (controller) 400 quickly reduces or blocks the excessive voltage. In other words, the main control circuit (controller) 400 performs the desired operation independently of the detection of the short circuit between terminals.

(4) Ensuring of Margin for Overvoltage Detector, etc.

The overvoltage detector 620 detects an excessive voltage when a short circuit occurs through the short circuit resistor RSN (illustrated in FIG. 8) and/or the short circuit resistor RSP (illustrated in FIG. 9). The resistances of the short circuit resistors RSN and RSP vary depending on the short circuit. If the resistances of the short circuit resistors RSN and RSP are large, the first and second detection signals SPins and DPins with relatively low voltages are reduced in voltage by the short circuit resistors with the large resistances. Thus, the first and second detectors 667 and 670 may not detect short circuit signals. Even in such cases, the overvoltage detector 620 detects the excessive voltage that has occurred due to the application of the high voltage, while the short circuit exists. Thus, the overvoltage detector 620 can detect the short circuit.

If a voltage to be input to the overvoltage detector 620 is switched by a switch or the like and the overvoltage detector 620 performs a detection of an excessive voltage only upon the application of the high voltage, the overvoltage detector 620 does not detect the excessive voltage in real time. In order to detect the excessive voltage in real time, the overvoltage detector 620 needs to constantly receive a voltage applied to the fourth detection terminal 540. Thus, a voltage in which the second detection signal DPins is reflected is input to the overvoltage detector 620 upon the application of the high voltage and the detection of the second detection signal DPins. It is unacceptable that the overvoltage detector 620 practically operate only upon an application of a higher voltage than the voltage of the second detection signal DPins and erroneously detect, as an excessive voltage, the voltage in which the second detection signal DPins has been reflected.

In the present embodiment, the voltage of the second detection signal DPins is reliably dropped by a voltage drop element (including the diodes 641, 642, 645 and the resistors Ra and Rb) in order to prevent the overvoltage detector 620 from erroneously detecting the second detection signal DPins, while the voltage drop element is arranged between the overvoltage detector 620 and the third detection terminal 510 or the fourth detection terminal 540 (connection node ND1: refer to FIGS. 8 and 9). This is due to the fact that only the voltage, in which the second detection signal is reflected and which is to be input to the overvoltage detector 620, is reliably dropped by the voltage drop element. The voltage that is to be input to the overvoltage detector 620 through the short circuit resistors RSN and RSP upon the application of the high voltage is originally large. Thus, even when the voltage that is to be input to the overvoltage detector 620 is dropped by the voltage drop element (including the diodes 641, 642, 645 and the resistors Ra and Rb), the overvoltage detector 620 can reliably detect the voltage. The voltage drop element may be made up of one or more resistors, a voltage dividing circuit provided with a plurality of resistors, one or more diodes, a combination thereof, or the like.

When the voltage that is dropped by the voltage drop element is higher than logic level voltages that are the first and second detection signals SPins and DPins and the like, the dropped voltage can be detected by the overvoltage detector 620 as an excessive voltage. In addition, the voltages of the devices (sub-control circuit 500 and storage device 203) to be protected can be lower than the absolute maximum rated voltages. Thus, the devices can be protected when the excessive voltage is detected.

As illustrated in FIG. 5, 8 or 9, in the present embodiment, the current limiting resistor Rr limits the amount of a current of the second detection signal DPins that is output from the third detection terminal 510. Since the electric device (sensor) 208 that has a higher resistance than the wiring 206 is arranged in a path in which the first detection signal SPins flows, it is preferable that the current limiting resistor Rr that limits the amount of the current of the second detection signal DPins be arranged in order to maintain a balance with the electric device.

As illustrated in FIGS. 8 and 9, the voltage drop element may include the first resistor Ra and the second resistor Rb. The first resistor Ra is arranged between the overvoltage detector 620 and the third detection terminal 510 or the fourth detection terminal 540 (connection node ND1). The second resistor Rb is arranged a ground and a connection node ND2 that is arranged between the first resistor Ra and the overvoltage detector 620. The voltage dividing circuit may be made up of the current limiting resistor Rr and the first and second resistors Ra and Rb so as to ensure a margin M for preventing the overvoltage detector 620 from erroneously detecting a voltage.

Figure 11:
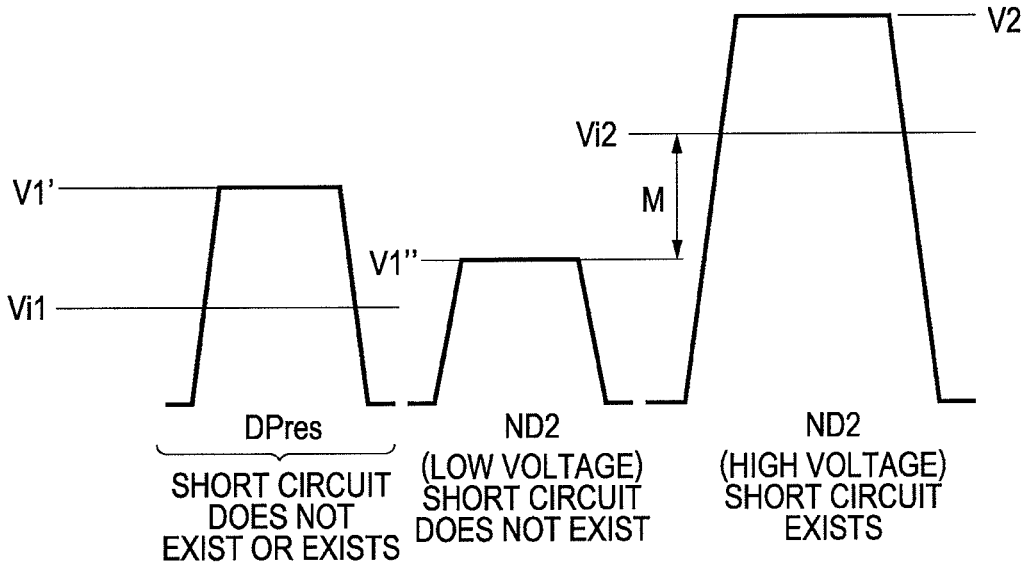
FIG. 11 is a diagram illustrating a detection margin for an overvoltage detector.

As illustrated in FIG. 11, during the detection of an attachment and the detection of a short circuit, the first detector 667 compares the voltage of the first detection response signal SPres with a first threshold Vi1 and can detect the attachment and the short circuit. In addition, during the detection of an attachment and the detection of a short circuit, the second detector 670 compares the voltage of the second detection response signal DPres with the first threshold Vi1 and can detect the attachment and the short circuit. During the detection of an attachment, the detection of a short circuit and the detection of an excessive voltage, the overvoltage detector 620 compares a second threshold Vi2 with a voltage of the connection node ND2 and can detect the attachment, the short circuit, and the excessive voltage. A voltage V1" (of the connection node ND2) that is to be input to the overvoltage detector 620 can be set on the basis of the resistances of the first and second resistors Ra and Rb and the resistance of the current limiting resistor Rr so that the voltage V1" is sufficiently lower than the second threshold Vi2 when the first and second detectors 667 and 670 detect, on the basis of the second detection signal DPins (=V1), a voltage V1' that is higher than the first threshold Vi1.

Thus, the first and second resistors Ra and Rb and the current limiting resistor Rr ensure the margin M (refer to FIG. 11) for preventing the overvoltage detector 620 from erroneously detecting a voltage.

Figure 12:
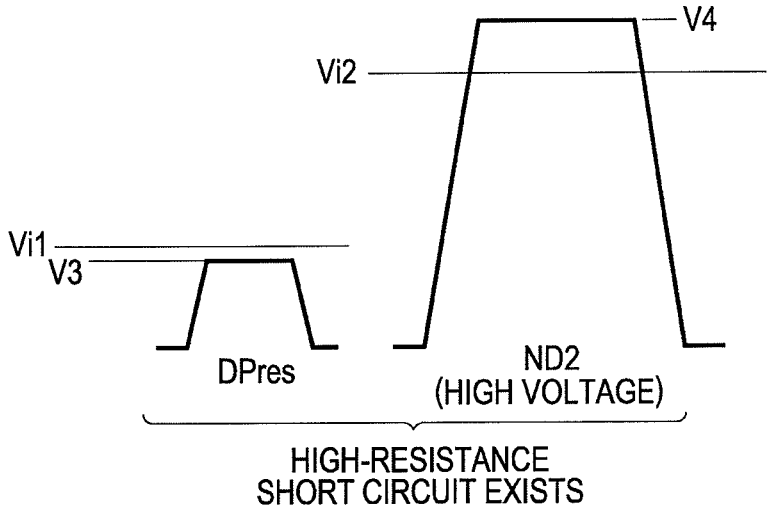
FIG. 12 is a diagram explaining an operation of detecting a high-resistance short circuit by applying a high voltage when the high-resistance short circuit is formed.

FIG. 12 illustrates the case in which the short circuit resistor RSP has a high resistance and the second detection response signal DPres has a voltage V3 (V3<Vi1) so that the second detector 670 cannot detect a short circuit. In this case, the resistances of the first and second resistors Ra and Rb and the resistance of the current limiting resistor Rr can be set so that a voltage V4 (of the connection node ND2) that is to be input to the overvoltage detector 620 on the basis of the application of the high voltage is higher than the second threshold Vi2.

The printing device 1000 can have a function of detecting an excessive voltage and thereby detecting a short circuit that is not detected by the first and second detectors 667 and 670 when the short circuit resistor has the high resistance. It should be noted that the first and second thresholds Vi1 and Vi2 illustrated in FIGS. 11 and 12 may be substantially equal to each other.

When the resistances of the current limiting resistor, the first resistor and the second resistor are Rr, Ra and Rb, a voltage dropped by the diodes is Vd, the first and second thresholds are Vi1 and Vi2, the high-level voltage of the second detection signal Dpins is V1, the following Formulas 1 and 2 are established.

$$(V1-Vd)\times(Ra+Rb)/(Rr+Ra+Rb)>Vi1 \quad \text{(Formula 1)}$$

$$(V1-Vd)\times Rb/(Rr+Ra+Rb)<Vi2 \quad \text{(Formula 2)}$$

When a lower limit of voltages that are applied to the contact portions of the third and fourth detection terminals 510 and 540 of the printing device 1000 and the contact portions of the second terminals 210 and 240 of the cartridge 100 and determined as excessive voltages is V2, the following Formula 3 is established.

$$(V2-Vd)\times Rb/(Ra+Rb)>Vi2 \quad \text{(Formula 3)}$$

The resistance Rr of the current limiting resistor and the resistances Ra and Rb of the first and second resistors can be determined according to the aforementioned Formulas 1 to 3.

The detection margin M for the overvoltage detector 620 is represented by the following Equation 4.

$$M=Vi2-V1''=Vi2-V1\times Rb/(Rr+Ra+Rb) \quad \text{(Equation 4)}$$

By ensuring the margin M, it is possible to reliably suppress an erroneous detection.

For the printing device 1000 illustrated in FIG. 5, the sensors 208 of the printing material containers (ink cartridges) IC1 and IC2 may use capacitor elements to detect remaining amounts of the printing materials (ink or the like). In this case, the printing device 1000 illustrated in FIG. 5 may include discharge elements M1 and M4 (illustrated in FIGS. 8 and 9) in order to discharge charges accumulated in the capacitor elements before the aforementioned types of detections.

The reason that the printing device 1000 may include the discharge elements M1 and M4 is that when the capacitor elements that serve as the sensors 208 have charges accumulated therein, currents generated due to the charges and voltages generated due to the charges may cause an error of a measurement performed by the first detector 667, the second detector 670 or the overvoltage detector 620 or reduce the margin M for the overvoltage detector 620.

In this case, a path for discharging charges accumulated in the sensors (capacitor elements) 208 before the detections may be provided. The discharge path is formed when the discharge elements (MOS transistors) M1 and M4 (illustrated in FIGS. 8 and 9) are turned on. The charges that are accumulated in the sensors (capacitor elements) 208 are discharged through the discharge path. Thus, the amounts of charges accumulated in the sensors 208 become zero. After that, the detections are performed. Thus, reductions in the accuracy of the detections and a reduction in the margin M are suppressed.

In the printing device 1000 illustrated in FIG. 5, the first detection terminals 550 of the device body 1010 are arranged adjacent to the third detection terminals 510 of the device body 1010, respectively, while the second detection terminals 590 of the device body 1010 are arranged adjacent to the fourth detection terminals 540 of the device body 1010, respectively. The third, fourth, first and second detection terminals 510, 540, 550 and 590 of the printing body 1010 correspond to the terminals 210, 240, 250 and 290 (refer to FIG. 3A) of the cartridges, respectively.

When the first detection terminal 550 is arranged adjacent to the third detection terminal 510, it is highly likely that the first and third detection terminals 550 and 510 are short-circuited due to conductive ink or the like and an excessive voltage occurs, for example. When the second detection terminal 590 is arranged adjacent to the fourth detection terminal 540, it is highly likely that the second and fourth detection terminals 590 and 540 are short-circuited and an excessive voltage occurs, for example. Thus, detections of the short circuits are important. The same applies to an arrangement of the first and fourth detection terminals 550 and 540 when the first and fourth detection terminals 550 and 540 are arranged adjacent to each other. In addition, the same applies to an arrangement of the second and third detection terminals 590 and 510 when the second and third detection terminals 590 and 510 are arranged adjacent to each other. In such cases, it is important to take measures against excessive voltages.

The main control circuit (controller) 400 that is included in the printing device 1000 illustrated in FIG. 5 controls the aforementioned inspections before the printing device 1000 performs a printing operation. When a short circuit or an excessive voltage is detected, the main control circuit (controller) 400 can reduce or block the voltage output from the high voltage generator 661.

The method for controlling the printing device 1000 can improve safety for the high-voltage driving that is performed by the printing device 1000. Referring to FIG. 5, the switches TS1, TS2, SW1, SW2, SW1' and SW2' are analog switches that are turned on and off by the main control circuit (controller) 400.

Although the embodiment is described above, it will be easily understood by those skilled in the art that many modifications and changes can be made herein without materially departing from the new matters and effects of the invention. Thus, such changes and modifications are all included in the scope of the invention. For example, terms that are described together with different broader or synonymous terms at least once in this specification or the drawings can be replaced with those different terms in any section of the specification and the drawings.

Figure 13:
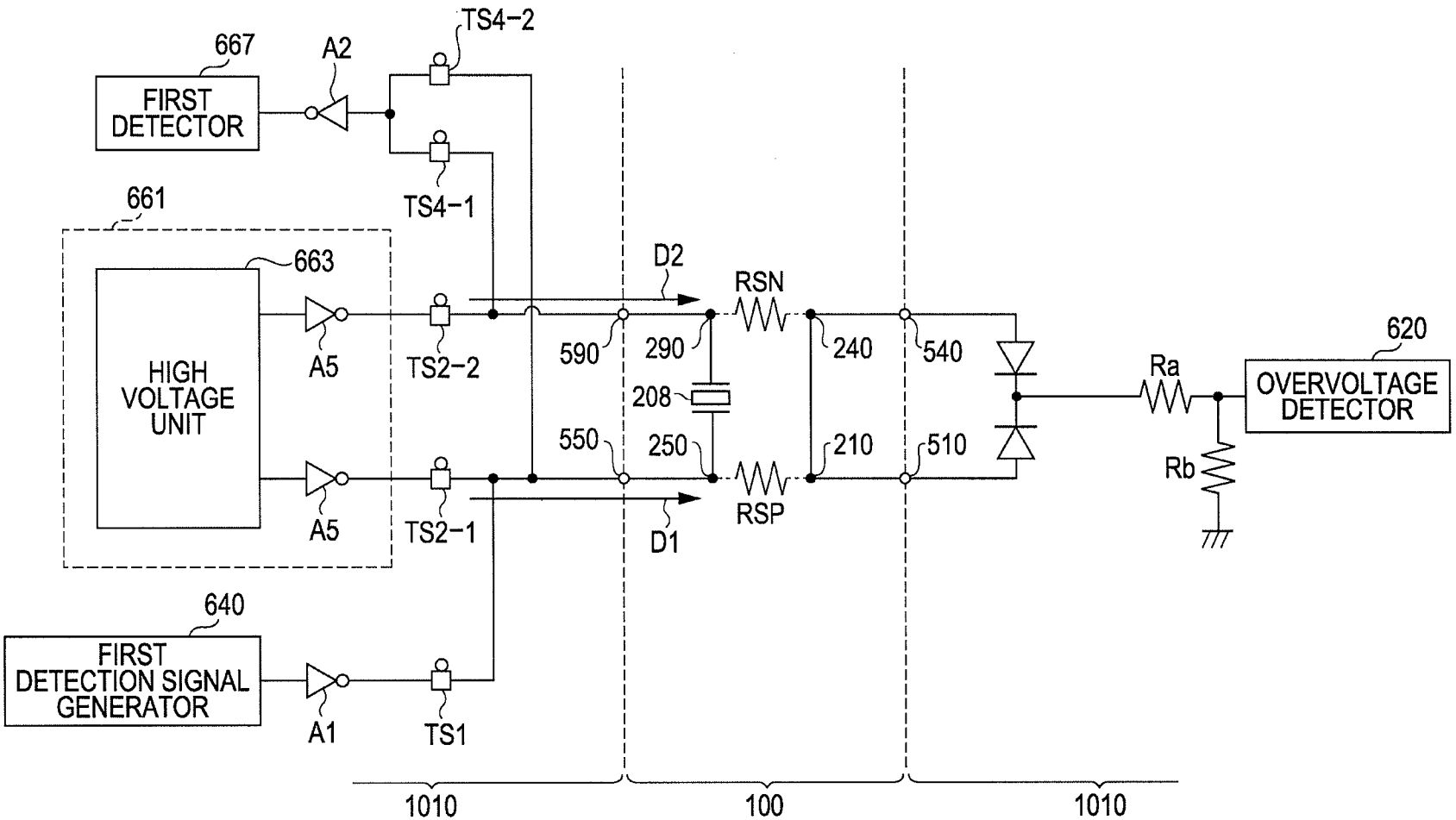
FIG. 13 is a diagram illustrating a modified example in which a first or second detection terminal is selected so that a high voltage is output from a high voltage generator to the selected detection terminal.

For example, as illustrated in FIG. 13, the printing body 1010 may include switches TS2-1 and TS2-2 that select the first or second detection terminal 550 and 590 and output the voltage output from the high voltage generator 661 to the selected detection terminal. When the switch TS2-1 is turned on, the high voltage generator 661 supplies the high voltage to the first detection terminal 550 as indicated by an arrow D1. In this case, the high voltage is detected by the overvoltage detector 620 through the short circuit resistor RSP. When the switch TS2-2 is turned on, the high voltage generator 661 supplies the high voltage to the second detection terminal 590 as indicated by an arrow D2. In this case, the high voltage is detected by the overvoltage detector 620 through the short circuit resistor RSN.

In this configuration, when the second detection terminal 590 and the third or fourth detection terminal 510 or 540 are short-circuited, an excessive voltage can be detected by the overvoltage detector 620. When the first detection terminal 550 and the third or fourth detection terminal 510 or 540 are short-circuited, an excessive voltage can be detected by the overvoltage detector 620.

The aforementioned operation can be achieved when the switches SW1 and SW1' illustrated in FIG. 5 are replaced with tri-state switches. In order to block the supply of the high voltage to the first detector 667, switches TS4-1 and TS4-2 are turned off.

The entire disclosure of Japanese Patent Application No. 2011-139525, filed on Jun. 23, 2011 is expressly incorporated herein by reference.

What is claimed is:

1. A printing device to which a printing material container can be attached and that receives a printing material from the printing material container and performs printing, the printing material container having two first terminals, two second terminals, an electric device connected between the two first terminals, and a wiring connecting the second terminals to each other, the printing device comprising:

first and second detection terminals that contact the two first terminals when the printing material container is attached to the printing device;

third and fourth detection terminals that contact the two second terminals when the printing material container is attached to the printing device;

a first detection signal generator that outputs a first detection signal to the first detection terminal;

a first detector that is connected to the second detection terminal;

a second detection signal generator that outputs, to the third detection terminal, a second detection signal that is different from the first detection signal;

a second detector that is connected to the fourth detection terminal;

a high voltage generator that outputs, to at least one of the first and second detection terminals, a high voltage that is higher than voltages of the first and second detection signals;

an overvoltage detector that detects whether or not the high voltage has been output to at least one of the third and fourth detection terminals; and a voltage drop element that is arranged between the third or fourth detection terminal and the overvoltage detector.

2. The printing device according to claim 1, wherein the first detector detects the first detection signal output from the first detection terminal through a first attachment detection path including the electric device and the two first terminals, detects contacts of the first and second detection terminals with the two first terminals, and detects a short circuit between the second and third detection terminals on the basis of the second detection signal, wherein the second detector detects the second detection signal output from the third detection terminal through a second attachment detection path including the wiring and the two second terminals, detects contacts of the third and fourth detection terminals with the two second terminals, and detects a short circuit between the first and fourth detection terminals on the basis of the first detection signal, and wherein the high voltage generator outputs the high voltage after it is determined that the detections of the first and second detectors are normal.

3. The printing device according to claim 2, further comprising a current limiting resistor that limits the amount of a current of the second detection signal output from the third detection terminal, wherein the voltage drop element includes a first resistor and a second resistor, the first resistor being arranged between the third or fourth detection terminal and the overvoltage detector, the second resistor being arranged between a ground and a connection node that is arranged between the first resistor and the overvoltage detector.

4. The printing device according to claim 3, wherein the second detector compares a voltage of the fourth detection terminal with a first threshold and performs a detection, wherein the overvoltage detector compares a voltage of the connection node with a second threshold and performs a detection, and wherein resistances of the first and second resistors and a resistance of the current limiting resistor are set so that the voltage of the connection node, which is input to the overvoltage detector due to the second detection signal, is lower than the second threshold when the short circuits do not exist and the second detector compares the second detection signal with the first threshold and performs a detection.

5. The printing device according to claim 4, wherein the resistances of the first and second resistors and the resistance of the current limiting resistor are set so that the voltage of the connection node, which is input to the overvoltage detector on the basis of an application of the high voltage, is higher than the second threshold when a short circuit resistor has a high resistance and any of the first and second detectors cannot detect the short circuit.

6. The printing device according to claim 5, wherein when the resistances of the current limiting resistor, the first resistor and the second resistor are Rr, Ra and Rb, the first threshold is Vi1, the second threshold is Vi2, and a high-level voltage of the second detection signal is V1, $V1\times(Ra+Rb)/(Rr+Ra+Rb)>Vi1$, and $V1\times Rb/(Rr+Ra+Rb)<Vi2$, and wherein when a lower limit of voltages that are applied to connection nodes of the third and fourth detection terminals and determined as excessive voltages is V2, $V2\times Rb/(Ra+Rb)>Vi2$.

7. The printing device according to claim 1, further comprising a switch that selects the first or second detection terminal and outputs, to the selected first or second detection terminal, the high voltage received from the high voltage generator.

8. The printing device according to claim 1, further comprising a discharge element, wherein the electric device of the printing material container is a sensor that uses a capacitor element to detect whether or not a remaining amount of a printing material contained in the printing material container is equal to or larger than a predetermined amount, and wherein the discharge element discharges charges accumulated in the capacitor element before the output of the first and second detection signals.

* * * * *